US006223640B1

(12) United States Patent
Sundström

(10) Patent No.: US 6,223,640 B1
(45) Date of Patent: May 1, 2001

(54) SAW CHAIN HAVING SIDE LINKS WITH LUBRICANT-RECEIVING RECESSES

(75) Inventor: Erik Sundström, Sandviken (SE)

(73) Assignee: Sandvik Aktiebolag, Sandviken (SE)

( * ) Notice: Subject to any disclaimer, the term of this patent is extended or adjusted under 35 U.S.C. 154(b) by 0 days.

(21) Appl. No.: 09/104,369

(22) Filed: Jun. 25, 1998

(30) Foreign Application Priority Data

Jun. 26, 1997 (SE) ..... 9702460

(51) Int. Cl.[7] ..... B27B 33/14; B27B 17/02

(52) U.S. Cl. ..... 83/830; 30/383; 384/12; 474/140; 474/165

(58) Field of Search ..... 83/830, 831, 832, 83/833, 834; 30/381, 383; 384/12; 474/140, 144, 165, 206

(56) References Cited

U.S. PATENT DOCUMENTS

| | | | | |
|---|---|---|---|---|
| 2,748,810 | | 6/1956 | Strunk | 30/123.4 |
| 2,891,586 | * | 6/1959 | Wright | 83/833 X |
| 3,170,497 | | 2/1965 | Ehlen et al. | 83/833 |
| 3,913,979 | * | 10/1975 | Strauss et al. | 83/831 X |
| 3,921,490 | | 11/1975 | Dolata et al. | 83/833 |
| 4,606,253 | * | 8/1986 | Weigel | 83/830 |
| 4,619,172 | * | 10/1986 | Perez | 83/830 |
| 4,754,549 | * | 7/1988 | Fischer et al. | 83/830 X |
| 4,813,323 | * | 3/1989 | Harfst | 83/830 |
| 4,979,416 | * | 12/1990 | Nitschmann | 83/834 |
| 5,029,501 | * | 7/1991 | Smith | 83/830 X |
| 5,226,404 | * | 7/1993 | Mogi et al. | 83/831 X |

* cited by examiner

*Primary Examiner*—Clark F. Dexter
(74) *Attorney, Agent, or Firm*—Burns, Doane, Swecker & Mathis, L.L.P.

(57) ABSTRACT

A chain saw comprises interconnected center links and side links. The side links include front and rear heels having front and bottom contact surfaces, respectively, which slidably engage an edge rail of a chain saw guide bar. The bottom contact surface of at least one of the heels includes a recess formed therein. The recess has an open front end and a closed rear end. The recess is of less width than a width of the respective bottom contact surface, whereby portions of the contact surface straddle the recess. The depth and width of the recess gradually decrease from the front end toward the rear end. During a cutting operation, lubricant enters the recess and creates a pressure which lifts the heel slightly off the rail, eliminating metal to metal contact.

8 Claims, 1 Drawing Sheet

SAW CHAIN HAVING SIDE LINKS WITH LUBRICANT-RECEIVING RECESSES

BACKGROUND OF THE INVENTION

The present invention relates to saw chains for chain saws and, in particular, to a configuration of side links of the saw chain.

As depicted in FIG. 4, a saw chain 2 for cutting wood is usually made with center drive links 4, and side links 6. The purpose of the drive links 4 is to drive the chain in direction D by a force from a motor-powered drive sprocket (not shown) and to guide the chain along a groove around the edge of a guide bar (not shown). The side links 6 are connected to the drive links for the purpose of carrying loads in the plane of the guide bar by sliding contact with the guide bar edge rails on each side of the groove. Some of the side links 6A may serve as cutter links.

To minimize wear of the side links a lubricant is fed to the groove by a pump, and distributed along the groove by a scoop-like cutout in the lower part of the center links. The lubricant will spread to the inner sides of the groove to lubricate the sides of the drive links, although only small forces act between the link sides and the groove sides. The lubricant will also spread upwards along the center links to lubricate the rivets connecting the drive links to the side links. Some lubricant will also spread to the edge rails, where it is needed because there is always sliding friction with considerable pressure between the chain and the rails due to the curvature and the cutting force.

Most guide bars have today a nose sprocket to carry a curved front portion of the chain around the guide bar nose without imposing a radial load on the side links, leaving the straight cutting portion of the chain as the most critical region for lubrication. Unfortunately this portion is also the most inaccessible, since the chain has by then already travelled the length of the guide bar, as well as around the nose with extreme rotational velocity, and thrown off most of the lubricant. Various guide bar designs have been suggested with lubricant channels extending to or past the nose, such as U.S. Pat. No. 2,748,810.

A further complicating factor is that the lower contact surface of a side link is usually provided with two heels located at respective front and rear ends of the link. The heels are oriented for sliding contact along the longitudinal edges of the guide bar, which edges are not straight in cross section but instead are slightly convex to ensure that tension in the chain will keep the chain in the groove even when it is not cutting. The heels are thus flat bottomed and almost, but not quite, aligned with one another. Between the heels the link may have a cutout with a large radius to fit the guide bar nose if the chain is to be used on a guide bar without nose sprocket, or with a sprocket lifting the links only a small distance off the edges. In the middle there is often a deeper cutout to allow higher teeth to be used on the nose sprocket.

If the heels of the side link are made to fit the edge rails with a fairly large contact surface but have an abrupt front end, most of the lubricant will be pushed off the edge rail with no beneficial effect on the wear. There has been a number of suggestions for heel designs where the lubricant is supposed to be retained on the edge rail to minimize wear. Ehlen et al. U.S. Pat. No. 3,170,497 shows in front of the front heel an extension with an inclined bottom, creating a wedge-shaped space to squeeze the lubricant under the heel. Dolata et al. U.S. Pat. No. 3,921,490 shows that the front heel can be shortened to make room for the inclined bottom without an extension. Neither of these expedients is very effective, since most of the lubricant is squeezed out to the side rather than under the heel.

The present invention concerns a saw chain with side links designed to collect and concentrate the lubricant onto the edge rails and to act as hydrodynamic bearings sliding along the edge rails without metallic contact.

SUMMARY OF THE INVENTION

According to the invention, a saw chain comprises interconnected center links and side links. The side links include front and rear heels having front and rear bottom contact surfaces, respectively, which are adapted to slidably engage an edge rail of a chain saw guide bar. The bottom contact surface of at least one of the front and rear heels includes a recess formed therein. The recess has an open front end and a closed rear end. The recess is of less width than a width of the respective bottom contact surface, whereby portions of the respective bottom contact surface straddle the recess.

Preferably, a depth of the recess gradually decreases from the front end toward the rear end, and the width of the recess preferably also gradually decreases toward the rear end. The heels are made to perform as hydrodynamic bearings, squeezing the lubricant under the heels with little loss to the sides.

BRIEF DESCRIPTION OF THE DRAWING

A side link according to the invention is described with reference to the figures, wherein.

DETAILED DESCRIPTION OF A PREFERRED EMBODIMENT OF THE INVENTION

Figure 1:
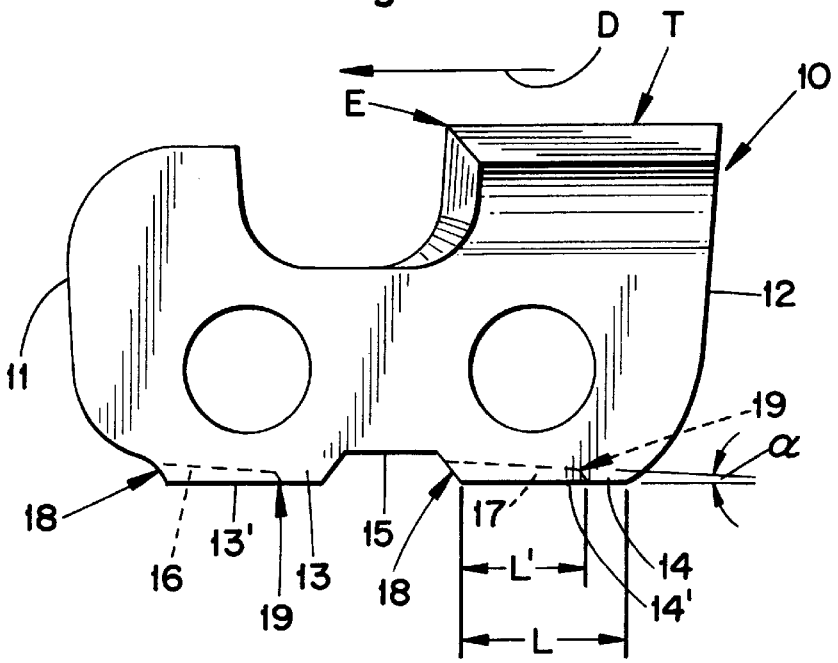
FIG. 1 shows a lateral view of a side link.
Figure 2:
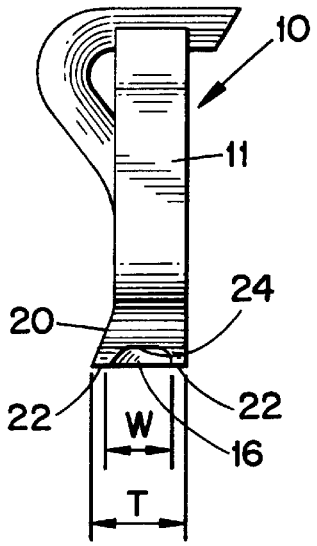
FIG. 2 shows a front end view of the side link
Figure 3:
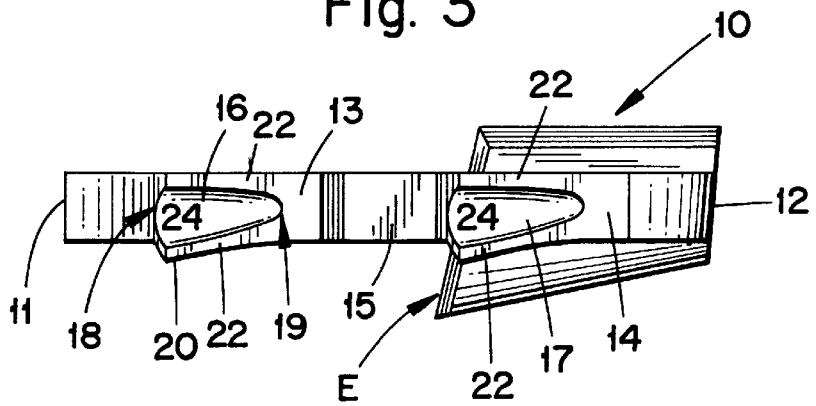
FIG. 3 shows a bottom view of the side link.
Figure 4:
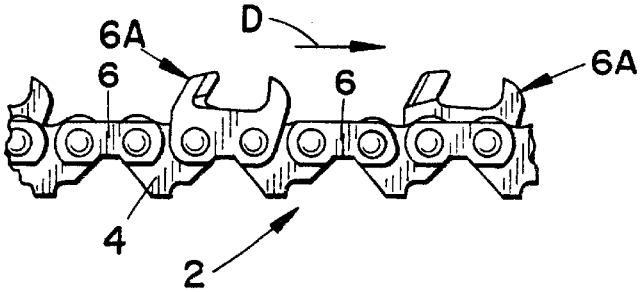
Fig. 4 (PRIOR ART)
FIG. 4 shows a side view of a fragment of a conventional saw chain.

A side link (10) according to the invention constitutes a cutting link having a cutting edge E on a top side T thereof. The link 10 has one front end (11) and one rear end (12), one front heel (13), one rear heel (14) and a cutout (15) between the heels to receive sprocket teeth. The contours of the heels (13, 14) are aligned with each other (FIG. 1) or preferably very slightly inclined relative to one another to match a curvature of a guide bar edge. Each recess includes a bottom contact surface (13' or 14'). The contact surface of at least one of the heels has a recess (16, 17). Each recess has one end (18) open towards the front and one end (19) closed towards the rear. Each recess has a floor (24) facing away from the top side, and a depth of the recess is defined as a distance from the floor to the contact surface. Each recess is tapering with a gradually decreasing depth towards the closed end (19). An angle between the floor (24) and the contact surface is less than 30 degrees. The length L' of each recess is preferably between one third and two thirds of the length L of the heel (see FIG. 1), the closed end (19) preferably located in the middle third of the heel length. The width W of each recess (see FIG. 2) is less than the thickness T of the link, and parts (22) of the respective contact surface straddle the full length of the recess along the sides thereof, thereby acting as side barriers keeping the lubricant from escaping laterally. The width W also tapers toward the rear end (19), as can be seen in FIG. 3.

Tapering of the recess in depth and width has the effect of concentrating the lubricant towards the center of the edge rail with less lateral leakage to the sides. The lubricant accumulating rearwardly in the gradually decreasing depth serves to create a pressure within the recess, to lift the heel slightly off the rail and let it ride on a film of lubricant, eliminating metal-to-metal contact. It also allows wood particles entrained in the lubricant to flow with the lubricant under the heel without blocking the recess. The remaining heel surface disposed behind the recess serves as an impact bearing surface in case the cutting forces create larger forces than the lubricant film can withstand. The combined effect is to greatly reduce the wear of the chain and the guide bar. The front heel (13) and the rear heel (14) may have respective recesses, the sizes of which being different from one another. If the side link (10) is also a cutter link, the rear heel (14) may be made without a recess or with a very short recess, since it needs more impact bearing surface.

A preferred way to produce the recesses in the side link is to produce link blanks the traditional way by punching from a steel strip. The part of the link edge which corresponds to the heel contact surface is then coined to create the recess while the link is supported via the rivet holes. The coining tools have preferably a rounded work surface producing a recess with negligible risk of cracking. If coining makes the link locally somewhat thicker, the spreading of material (20) should be towards the outside, leaving the inner surface flat to rotate easily against the center link.

An alternative way is to grind the recesses, which will restrict the choice of tapering and depth variation, however.

An additional advantage resulting from the invention is that the recess (16 and/or 17) will serve as an indicator of wear. Even with the improved lubrication resulting from the presence of the recess(es), there will be some dry friction, e.g., when starting or when there is an insufficient supply of lubricant. Wear will produce a noticeable shrinking of the depth of the recesses, and the chain can be exchanged before it is so worn that it is liable to break, and if this begins to occur too early, the lubrication system can be readjusted or overhauled.

Although the present invention has been described in connection with a preferred embodiment thereof, it will be appreciated by those skilled in the art that additions, deletions, modifications, and substitutions not specifically described may be made without departing from the spirit and scope of the invention as defined in the appended claims.

What is claimed is:

1. A saw chain comprising interconnected center links and side links, at least some of the side links constituting cutting links and having a cutting edge on a top side thereof, each cutting link including front and rear heels having front and rear bottom contact surfaces, respectively for slidably engaging an edge rail of a chain saw guide bar; the bottom contact surface of at least one of the front and rear heels including a recess formed therein, the recess being open in a direction away from the top side and having a floor facing away from the top side, an open front end and a closed rear end, the recess being of less width than a width of the respective bottom contact surface, whereby portions of the respective bottom contact surface straddle the recess along the sides thereof.

2. The saw chain according to claim 1 wherein a depth of the recess gradually decreases from the front end toward the rear end.

3. The saw chain according to claim 2 wherein the floor forms an angle less than about 30 degrees with the respective contact surface.

4. The saw chain according to claim 2 wherein the width of the recess gradually decreases toward the rear end.

5. The saw chain according to claim 1 wherein the width of the recess gradually decreases toward the rear end.

6. The saw chain according to claim 1 wherein a distance from the front end to the rear end is less than two-thirds of a length of the respective bottom contact surface.

7. The saw chain according to claim 1 wherein a distance from the front end to the rear end is greater than one-third of a length of the respective bottom contact surface.

8. The saw chain according to claim 1 wherein the floor is concave in cross section.

* * * * *